US011761395B2

(12) United States Patent
Srinivasan

(10) Patent No.: US 11,761,395 B2
(45) **Date of Patent: *Sep. 19, 2023**

(54) DYNAMIC SKIP FIRE TRANSITIONS FOR FIXED CDA ENGINES

(71) Applicant: Tula Technology, Inc., San Jose, CA (US)

(72) Inventor: Vijay Srinivasan, Farmington Hills, MI (US)

(73) Assignee: Tula Technology, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/742,070

(22) Filed: May 11, 2022

(65) Prior Publication Data

US 2022/0268227 A1 Aug. 25, 2022

Related U.S. Application Data

(63) Continuation of application No. 16/950,632, filed on Nov. 17, 2020, now Pat. No. 11,359,561.

(51) Int. Cl.

| | |
|---|---|
| ***F01L 13/00*** | (2006.01) |
| ***F02D 13/06*** | (2006.01) |
| ***F02D 17/02*** | (2006.01) |
| ***F02D 41/00*** | (2006.01) |
| ***F02D 41/30*** | (2006.01) |
| ***F02D 41/40*** | (2006.01) |

(52) U.S. Cl.

CPC ..... *F02D 41/0087* (2013.01); *F02D 13/06* (2013.01); *F02D 17/02* (2013.01); *F02D 41/307* (2013.01); *F02D 41/3064* (2013.01); *F02D 41/401* (2013.01); *F01L 2013/001* (2013.01); *F02D 2250/21* (2013.01)

(58) Field of Classification Search

CPC .... F01L 2013/001; F02D 13/06; F02D 17/02; F02D 41/0087; F02D 41/3064; F02D 41/307; F02D 2013/001; F02D 2250/21

USPC ..... 701/101; 123/198 DB, 198 DC, 198 F, 123/481

See application file for complete search history.

(56) References Cited

U.S. PATENT DOCUMENTS

| | | | | |
|---|---|---|---|---|
| 6,619,267 | B1 * | 9/2003 | Pao | F02B 75/22 123/481 |
| 7,249,583 | B2 * | 7/2007 | Bidner | F01N 13/0093 123/198 DB |
| 7,577,511 | B1 | 8/2009 | Tripathi et al. | |
| 7,849,835 | B2 | 12/2010 | Tripathi et al. | |
| 7,886,715 | B2 | 2/2011 | Tripathi et al. | |

(Continued)

FOREIGN PATENT DOCUMENTS

DE 102019113564 A1 11/2019

OTHER PUBLICATIONS

International Searching Authority, International Search Report and Written Opinion dated Feb. 24, 2022, for International Application No. PCT/US2021/072216.

(Continued)

*Primary Examiner* — Erick R Solis

(74) *Attorney, Agent, or Firm* — Womble Bond Dickinson (US) LLP

(57) ABSTRACT

A variety of methods and arrangements are described for managing transitions between operational states of an internal combustion engine during skip fire operation of the engine.

20 Claims, 4 Drawing Sheets

(56) References Cited

U.S. PATENT DOCUMENTS

| | | | |
|---|---|---|---|
| 7,954,474 | B2 | 6/2011 | Tripathi et al. |
| 8,099,224 | B2 | 1/2012 | Tripathi et al. |
| 8,131,445 | B2 | 3/2012 | Tripathi et al. |
| 8,131,447 | B2 | 3/2012 | Tripathi et al. |
| 8,616,181 | B2 | 12/2013 | Sahandiesfanjani et al. |
| 8,701,628 | B2 | 4/2014 | Tripathi et al. |
| 8,839,766 | B2 | 9/2014 | Serrano |
| 9,086,020 | B2 | 7/2015 | Pirjaberi et al. |
| 9,120,478 | B2 | 9/2015 | Carlson et al. |
| 9,200,575 | B2 | 12/2015 | Shost |
| 9,200,587 | B2 | 12/2015 | Serrano |
| 9,239,037 | B2 | 1/2016 | Carlson et al. |
| 9,267,454 | B2 | 2/2016 | Wilcutts et al. |
| 9,273,643 | B2 | 3/2016 | Carlson et al. |
| 9,291,106 | B2 | 3/2016 | Switkes et al. |
| 9,328,672 | B2 | 5/2016 | Serrano et al. |
| 9,581,097 | B2 | 2/2017 | Younkins et al. |
| 9,650,971 | B2 | 5/2017 | Pirjaberi et al. |
| 9,664,130 | B2 | 5/2017 | Wilcutts et al. |
| 9,777,658 | B2 | 10/2017 | Nagashima et al. |
| 9,945,313 | B2 | 4/2018 | Kotwicki et al. |
| 10,247,121 | B2 | 4/2019 | Shost et al. |
| 10,393,085 | B2 | 8/2019 | Serrano |
| 10,494,971 | B2 | 12/2019 | Younkins et al. |
| 2006/0196463 | A1* | 9/2006 | Pallett ..... B60K 6/445 123/192.1 |
| 2007/0051350 | A1* | 3/2007 | Pallet ..... F02D 17/02 123/688 |
| 2007/0131196 | A1* | 6/2007 | Gibson ..... F02D 13/06 123/198 F |
| 2011/0220068 | A1* | 9/2011 | Ferch ..... F02D 37/02 123/481 |
| 2014/0045652 | A1* | 2/2014 | Carlson ..... B60W 30/19 477/109 |
| 2015/0322869 | A1* | 11/2015 | Shost ..... F02D 41/0002 123/481 |
| 2018/0334970 | A1 | 11/2018 | Kamo et al. |
| 2019/0048813 | A1 | 2/2019 | Dudar |
| 2020/0018197 | A1 | 1/2020 | McCarthy, Jr. |

OTHER PUBLICATIONS

International Preliminary Report on Patentability for PCT/US2021/072216 dated May 16, 2023, 8 pages.

* cited by examiner

DYNAMIC SKIP FIRE TRANSITIONS FOR FIXED CDA ENGINES

CROSS-REFERENCE TO RELATED APPLICATIONS

This application is a continuation of U.S. patent application Ser. No. 16/950,632 filed Nov. 17, 2020, the entire contents of which is incorporated herein by reference.

FIELD OF THE INVENTION

This present invention relates generally to variable displacement internal combustion engines, and more particularly to managing transitions between operational states of an internal combustion engine.

BACKGROUND OF THE INVENTION

Fuel efficiency of many types of internal combustion engines can be improved by varying the displacement of the engine. This allows for the use of full displacement when full torque is required and the use of a smaller displacement when full torque is not required. The displacement of the engine can be varied using cylinder deactivation (CDA), which reduces engine displacement by deactivating subsets of cylinders. When a cylinder is deactivated, the intake and exhaust valve remain closed and fuel injection is stopped. For example, an eight-cylinder engine can reduce its displacement by half by deactivating four cylinders. Likewise, a four-cylinder engine can reduce its displacement by half by deactivating two cylinders, or a six-cylinder engine can reduce its displacement to ⅓ by deactivating four cylinders. In all of these cases, the deactivated cylinders do not fire while the engine is operated at this reduced level of displacement.

These transitions from one displacement (a first displacement) to another displacement (a second displacement) (e.g., in an eight-cylinder engine, transitioning from a mode in which 4 cylinders are fired to a mode in which all 8 cylinders are fired) can cause a sudden change in engine output, which can generate undesirable noise, vibration and hardness (NVH), and also can cause a sudden change in air flow characteristics, which leads to poor emissions. In order to reduce the increased NVH that occurs during these transitions, the engine can be operated in a skip fire manner, which makes it possible to smoothly vary the induction ratio (IR) and the firing fraction (FF) during the transition.

However, in some engines, not all of the cylinders are capable of being deactivated due to hardware constraints. These types of engines are referred to as fixed-CDA engines. In a fixed-CDA engine, when a skip command is output for a cylinder that is incapable of deactivating, the skip command can be ignored and the cylinder can be fired. While this maintains the air/fuel (A/F) ratio, it produces excess torque that can cause an adverse effect on NVH.

SUMMARY

Methods for managing transitions between operational states of an internal combustion engine having a plurality of working chambers are described. One method comprises generating a firing sequence that includes one or more firing and skip commands for operating the working chambers and determining which working chamber the skip commands should be applied to. If the skip command should be applied to a deactivatable working chamber, the deactivatable working chamber is skipped. If the skip command should be applied to a non-deactivatable working chamber, fuel to the non-deactivatable working chamber is cut.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures, wherein.

DETAILED DESCRIPTION

Figure 1:
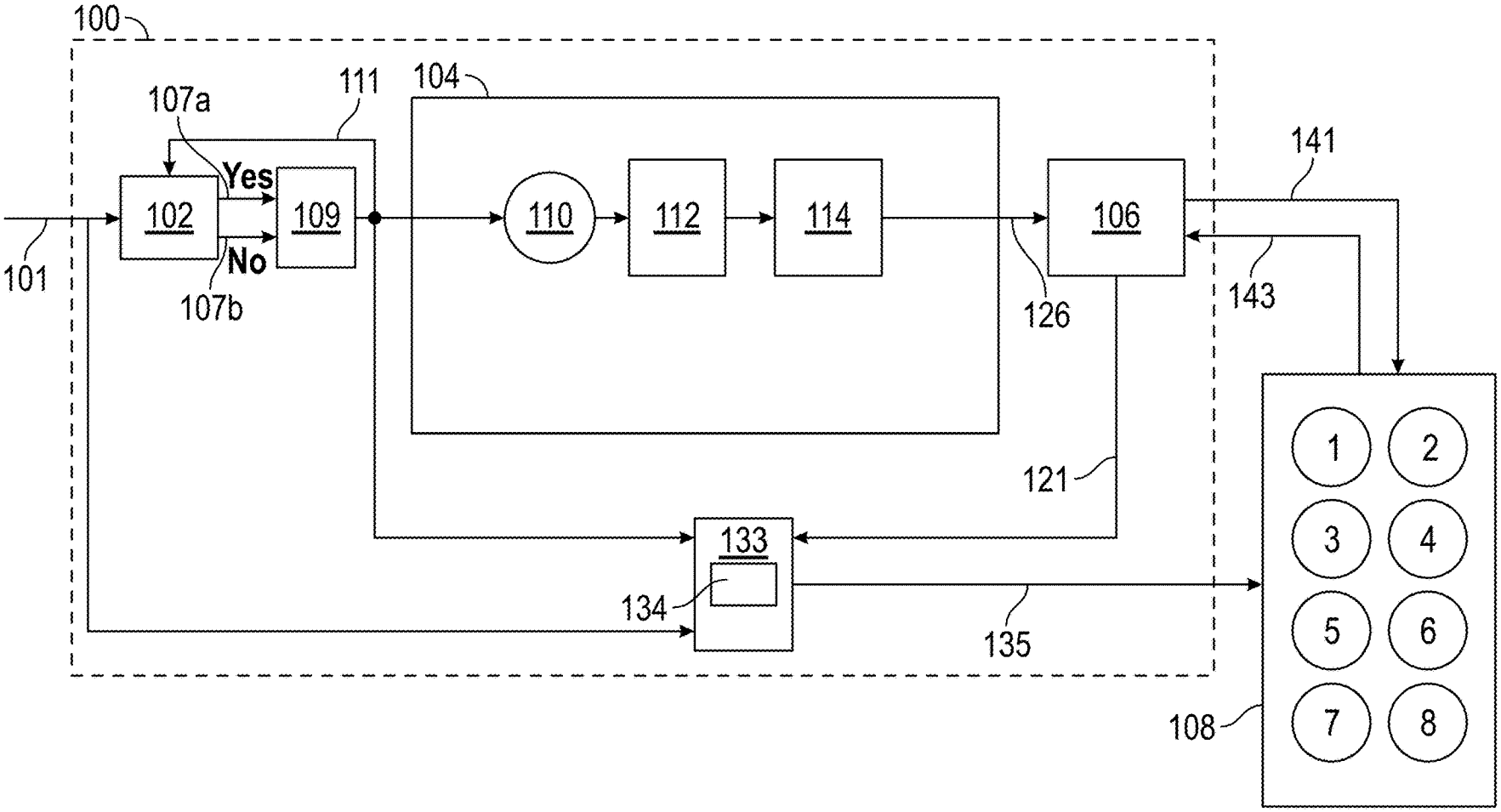
FIG. 1 shows a block diagram of an engine controller according to an embodiment of the present invention.

The subject innovation is now described with reference to the drawings, wherein like reference numerals are used to refer to like elements throughout. In the following description, for purposes of explanation, numerals specific details are set forth in order to provide a thorough understanding of the present invention. It may be evident, however, that the present invention may be practiced without these specific details.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

U.S. Pat. No. 8,839,766, which is incorporated herein by reference in its entirety, discusses transitions between operational states of an engine with fixed-CDA hardware while operating in a skip-fire manner. In U.S. Pat. No. 8,839,766, when a skip command is output for a cylinder that is incapable of deactivating, the skip command is ignored and the cylinder is fired. While this maintains the air/fuel (A/F) ratio, it causes an adverse effect on NVH and produces excess torque. In a gasoline engine, if air is sucked into a cylinder, that cylinder must be fueled in order to maintain stoichiometry in the cylinder. In a diesel engine or other lean-burning engine, where the A/F ratio is not as critical, the same NVH can be achieved by commanding a fuel cut for cylinders, as described in more detail below.

Generally, skip fire engine control involves deactivating one or more selected working cycles of one or more working chambers (i.e., cylinders) and firing one or more working cycles of one or more working chambers (i.e., cylinders). When cylinders are deactivated (i.e., skipped), the intake valve and exhaust valve remain closed and fuel injection is stopped. Individual working chambers are sometimes deactivated and sometimes fired. In various skip fire applications, individual working chambers have firing patterns that can change on a firing opportunity by firing opportunity basis by using a sigma delta, or equivalently a delta sigma, converter. Such a skip fire control system may be defined as dynamic skip fire control or "DSF." For example, an individual working chamber could be skipped during one firing opportunity, fired during the next firing opportunity, and then skipped or fired at the very next firing opportunity. The assignee of the present application has filed many applications involving skip fire engine operation, including U.S. Pat. Nos. 7,954,474; 7,886,715; 7,849,835; 7,577,511; 8,099,224; 8,131,445; 8,131,447; 8,616,181; 8,701,628; 9,086,020; 9,120,478; 9,200,575; 9,200,587; 9,650,971; 9,328,672; 9,239,037; 9,267,454; 9,273,643; 9,664,130; 9,945,313; 9,291,106; and 10,247,121, each of which is incorporated herein by reference in its entirety. Many of the aforementioned applications describe engine controllers, firing fraction calculators, filters, power train parameter adjusting modules, firing timing determination modules, ECUs and other mechanisms that may be incorporated into any of the described embodiments to generate, for example, a suitable firing fraction, skip fire firing sequence or torque output.

FIG. 1 shows a block diagram of an example engine controller 100 that can be used to implement at least one embodiment of the present invention. As shown in FIG. 1, the engine controller includes an operational state module 102, a firing fraction calculator 109, a power train parameter adjusting module 133, a firing timing determination module 104, and a fire control unit 106, which is coupled with the engine 108. The firing timing determination module 104 may include a sigma delta converter having an adder 110, an integrator 112, and a quantizer 114. In this particular example, the engine 108 has eight cylinders that can be operated in a four-cylinder mode (e.g., working chambers 2, 3, 5 and 8 can be selectively fired or deactivated while the other working chambers are fired at every firing opportunity), although the engine controller 100 may be modified as appropriate for any number of working chambers and different operational states.

Initially, an engine output request 101 is generated. Any suitable mechanism may be used to generate the engine output request, which may be based on the accelerator pedal position and a variety of other engine operating parameters, such as the engine speed, transmission gear, rate of change of accelerator pedal position or cruise control setting. The engine output request 101 is directed to the operational state module 102. The operational state module 102 records the current engine operational state and determines whether the current operating state is suitable for the engine output request 101. If the current operational state is suitable with the engine output request, engine control proceeds along the "yes" decision path 107*a*, which is acted upon by the firing fraction calculator 109.

The firing fraction calculator 109 is arranged to determine a firing fraction that would be appropriate to deliver the desired output. The firing fraction is indicative of the fraction or percentage of firings under the current (or directed) operating conditions that are required to deliver the desired output. In the above case, the "yes" decision path 107*a* causes the firing fraction calculator 109 to output a fixed firing fraction that corresponds to the current operational state. In the current example, the engine has two operational states, corresponding to a firing fraction of ½ and 1. Any number of operational states could be used. The firing fraction calculator 109 outputs a firing fraction signal 111 which is directed to the power train adjusting module 133, the firing timing determination module 104 and the operational state module 102.

The power train parameter adjusting module 133 is adapted to adjust selected power train parameters to adjust the output of each firing so that the actual engine output substantially equals the requested engine output 101 given the current firing fraction. Therefore, the power train parameter adjusting module 133 is arranged to adjust some of the engine's operational parameters appropriately so that the actual engine output when using the current firing fraction matches the desired engine output. The power train parameter adjusting module 133 includes a fuel module 134. The fuel module 134, which receives input 121 from the firing control unit 106 that indicates to which working chamber the current firing opportunity applies, can control the fuel injector of each cylinder in order to cut fuel to non-deactivatable cylinders as described herein. A number of parameters can readily be altered to adjust the torque delivered by each firing appropriately to ensure that the actual engine output using the current firing fraction matches the desired engine output. By way of examples, parameters such as throttle position, spark advance/timing, intake and exhaust valve timing, fuel charge, etc., can readily be adjusted to provide the desired torque output per firing. The output 135 of the power train parameter adjusting module 133 is directed to the engine where these parameters are adjusted.

The firing fraction 111 is also fed to the firing timing determination module 104. The firing timing determination module 104 is arranged to issue a sequence of firing commands (e.g., firing command 126) that cause the engine 108 to deliver the desired percentage of firings. The firing sequence is used to operate the working chambers of the engine 108 so that they are selectively fired or skipped in accordance with the sequence. The module 104 may take a wide variety of forms. In this example, the module 104 is a modified first order sigma delta converter, which includes an adder 110, integrator 112, and quantizer 114. The firing sequence can be determined using any suitable technique (e.g., an algorithm, a lookup table, etc.).

In the illustrated embodiment, the adder 110 receives the firing fraction 111 from the firing fraction calculator 109. The output of the adder 110 is sent to the integrator 112. The quantizer 114 receives the output of the integrator 112 and generates a sequence of values indicating individual firing/skip decisions (e.g., a bitstream in which a 0 indicates a skip and a 1 indicates a fire). This sequence is received at the fire control unit 106.

The fire control unit 106 may receive a signal 143 from the engine 108 indicative of the working chamber associated with the current firing opportunity. The firing decision then may be altered depending on the current operational state and whether the working chamber is capable of being deactivated or not. Consider the example shown in FIG. 1, in which the working chambers are numbered 1 through 8 and in which only working chambers 2, 3, 5 and 8 can be deactivated. Assume further that the output of the quantizer 114 indicates that there should be a skip at the current firing opportunity. If the current working chamber is one of working chambers 1, 4, 6 and 7, then the skip command will be changed to a cut-fuel command by the fuel module 134, since working chambers 1, 4, 6 and 7 cannot be deactivated. The fire control unit 106 then generates firing signal 141 that operates the current working chamber so that it is fired based on the "1" received in command 126.

Effectively the decision modifier 106 alters the firing sequence, so it is compatible with the current operational state, without altering the average firing fraction. The firing fraction 111 is also directed to the operational state module. In the illustrated embodiment, once the firing fraction 111 equals that of the current operational state, the operational state module 102 resets to the new operational state. Engine operation proceeds in that operational state, until the "no" signal is generated in the operational state module 102.

Consider now the case where the current operational state is not suitable for the engine output request. In some cases, an operational state having a higher firing fraction capable of producing a higher output may be suitable, since it can deliver a higher output level. Alternatively, in some cases an operational state having a lower firing fraction may be suitable, since it can deliver greater fuel economy.

Again consider an example engine having a set of four cylinders that cannot be deactivated and four cylinders that can be deactivated. This engine can have two operational modes. One is a four-cylinder operational state, which has the four cylinders that cannot be deactivated firing and the four cylinders that can be deactivated skipping. The other operational state is an eight-cylinder operational state, which has the four cylinders that cannot be deactivated firing and the four cylinders that can be deactivated firing as well. The maximum engine output when operating in the four-cylinder state is less than that available when operating in the eight-cylinder state. Assume the engine is initially operating in the four-cylinder operational state. If the engine output request 101 becomes sufficiently high, it cannot be supported by the four-cylinder operational state. In this case, the engine must transition to an eight-cylinder state that is capable of producing a higher engine output. This causes the engine controller 100 to begin the transition to the eight-cylinder operational state. In this case engine control proceeds along the "no" decision path 107*b* from operational state module 102.

Decision path 107*b* is directed to the firing fraction calculator 109. The firing fraction calculator 109 generates a firing fraction 111; however, in this case the firing fraction varies with time over the course of the transition between the operational states. This contrasts with the early case where the firing fraction was a fixed value corresponding to an operational state. In this case, at the beginning of the transition, the firing fraction is 0.5, corresponding to four of eight of the cylinders firing. At the end of the transition the firing fraction will be 1, corresponding to eight of eight cylinders firing. The firing fraction calculator may smoothly transition the firing fraction between these values during the transition. Many of the aforementioned co-assigned applications refer to a firing fraction calculator or other processes for calculating a suitable firing fraction based on an engine output request. Such mechanisms may be incorporated as appropriate into the described embodiment.

The previous example described the situation where the engine output request exceeded what could be supplied by the current operational state, causing the engine to transition to an operational state having a higher firing fraction. Similarly, if the current operational state is capable of producing a high output level and the engine output request is low, the engine can transition to an operational state with a lower firing fraction. Operation in this state may advantageously provide improved fuel economy.

It should be noted that the actual time required to make the transition from one operational state to another operational state is generally very brief. For example, in some embodiments, the total duration of the transition is less than one, two, three or five seconds. The aforementioned skip fire control is performed during this brief period to facilitate the shift between different operational states.

Figure 2:
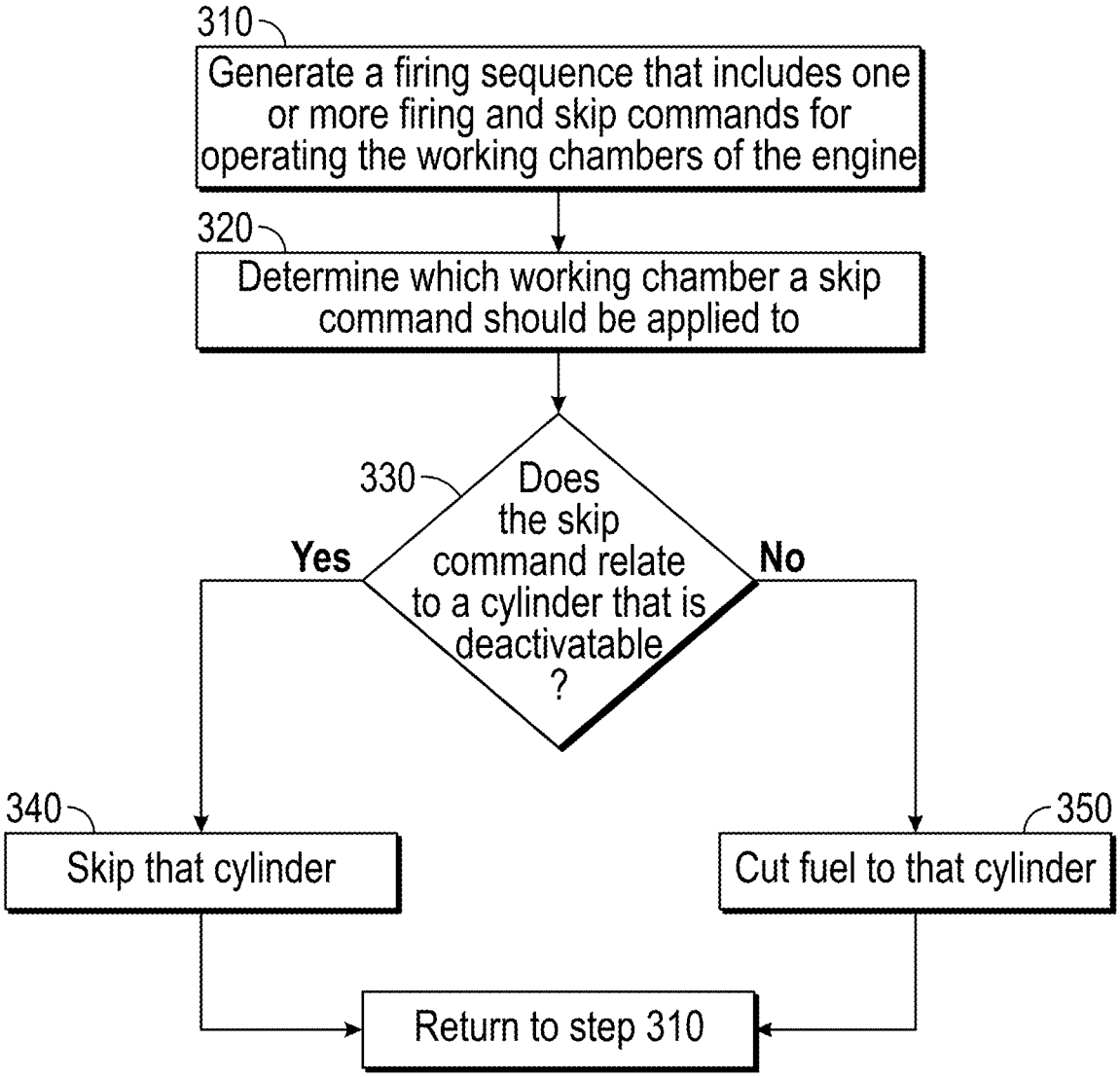
FIG. 2 shows an operation of one embodiment of the present invention.

FIG. 2 shows a flowchart according to at least one embodiment of the present invention. In Step 310, a firing sequence that includes one or more firing and skip commands for operating the working chambers of the engine is generated. In Step 320, it is determined to which working chamber a skip command should be applied. In Step 330, it is determined whether the skip command relates to a cylinder that is deactivatable. If the skip command relates to a cylinder that is deactivatable (YES branch), that cylinder is skipped, as shown in Step 340. If the skip command relates to a cylinder that is not deactivatable (NO branch), fuel is cut to that cylinder, as shown in Step 350. This process shown in FIG. 2 provides the benefit of helping to keep the firing pulses evenly spaced while transitioning to the new firing fraction. Also, the torque that is delivered is similar to the torque created with a first order sigma delta (FOSD) controller.

Figure 3A:
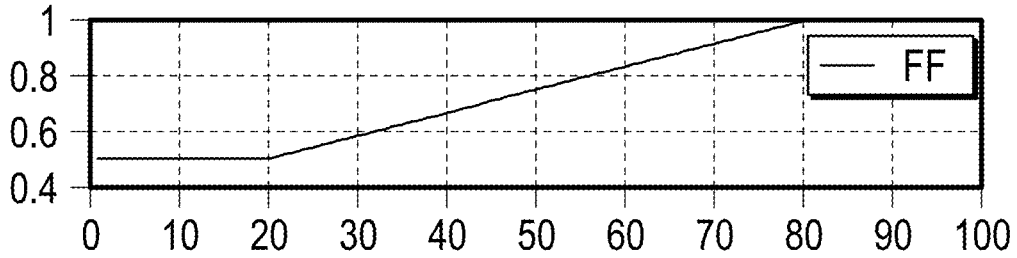
FIGS. 3A-3D show an operation of one embodiment of the present invention for fixed-CDA hardware with individual control capability.
Figure 3B:
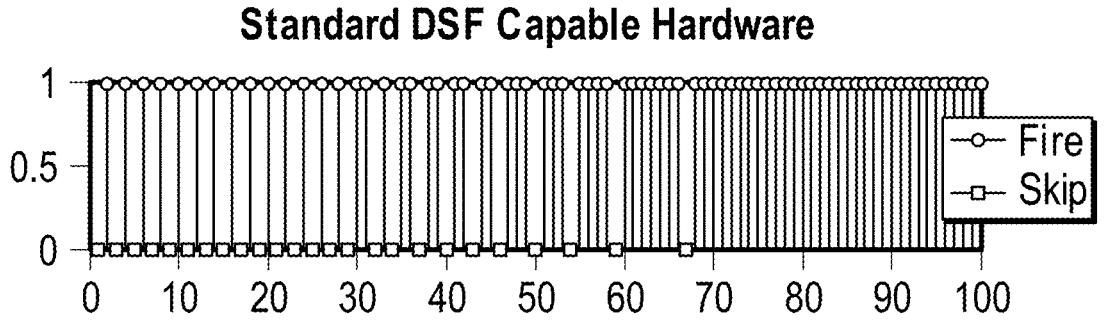
Figure 3C:
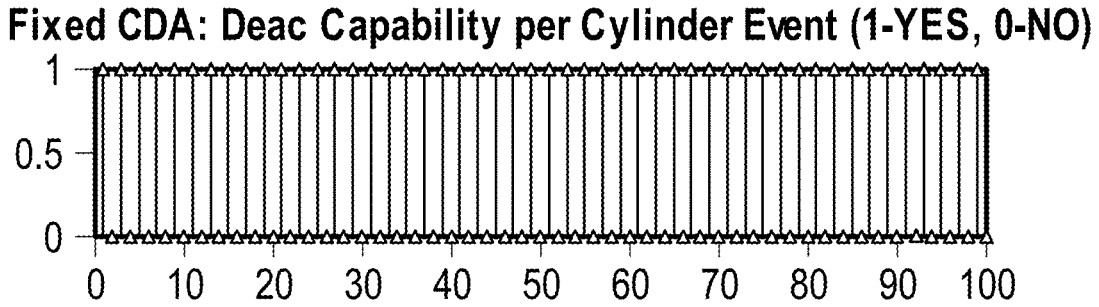
Figure 3D:
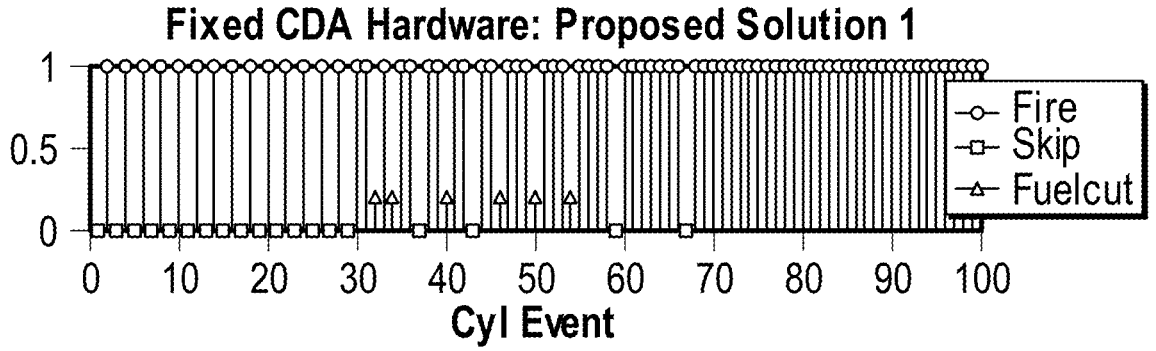

FIG. 3A shows an example transition from a firing fraction of 0.5 (e.g., firing 3 cylinders in a six-cylinder engine) to a firing fraction of 1.0 (e.g., firing all six cylinders in a six-cylinder engine). The firing fraction is shown in the vertical axis and the cylinder event is shown in the horizontal axis. For a six-cylinder engine, one engine cycle (2 revolutions of the crankshaft) equals six cylinder events. FIGS. 3B-3D show the firing sequences used to perform the transition shown in FIG. 3A from a firing fraction of 0.5 to a firing fraction of 1.0. Using a six-cylinder engine as an example having a firing order of 1-5-3-6-2-4 with only some of the cylinders being individually deactivatable (e.g., cylinders 1, 2 and 3), the flow chart shown in FIG. 2 can be demonstrated by FIGS. 3B-3D. In this context, "individually deactivatable" means that any one of the deactivatable cylinders (e.g. cylinders 1, 2 and 3) can be deactivated without having to deactivate the other two. In this example, the engine can be operated using 3, 4, 5, or 6 cylinders. In this context, a "deactivatable cylinder" means that the intake valve, exhaust valve and fuel injector for that cylinder can be controlled so that they can be deactivated (i.e., valves remain closed and fuel injection is stopped) during one or more cycles.

FIG. 3B shows the firing sequences for a six-cylinder engine that is operated in a skip-fire manner during transition from a firing fraction of 0.5 to a firing fraction of 1.0. In FIG. 3B, all six cylinders are capable of being deactivated. As shown in FIG. 3B, many cylinders are skipped during the transition from a firing fraction of 0.5 to a firing fraction of 1.0 in order to smoothly vary the IR and minimize NVH. Since all six cylinders are capable of being deactivated in a skip-fire manner, when a skip command is generated for a cylinder, that cylinder is skipped. However, when a fixed-CDA engine is used, not all of the cylinders are capable of being deactivated. For example, as shown in FIG. 3C, cylinder events 1, 3, 5, 7 and 9, etc. have deactivation capability. As shown in FIG. 3D, in a fixed-CDA engine, when a cylinder that is capable of being deactivated is commanded to skip, that cylinder is skipped. When a cylinder that is not capable of being deactivated is commanded to skip, fuel is cut to that cylinder per the logic set forth in FIG. 2. For example, as shown in FIG. 3B, at cylinder events 32 and 34, the DSF controller commands a skip. As shown in FIG. 3C, there is no deactivation capability at cylinder events 32 and 34. Therefore, as shown in FIG. 3D, at cylinder events 32 and 34, a fuel cut is performed. Similarly, a fuel cut is performed at cylinder events 40, 46, 50, and 54.

Figure 4A:
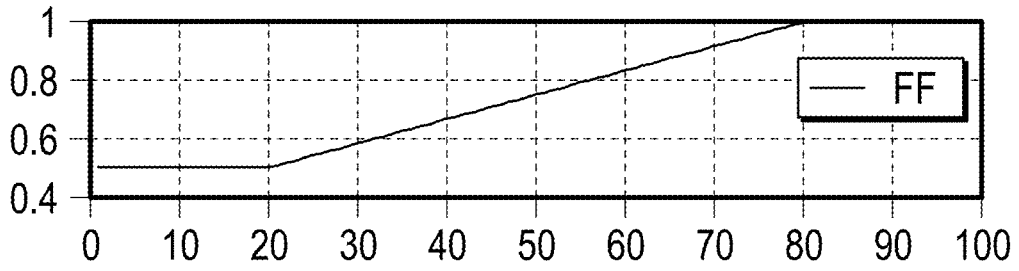
FIGS. 4A-4C show an operation of one embodiment of the present invention for fixed-CDA hardware without individual control capability.
Figure 4B:
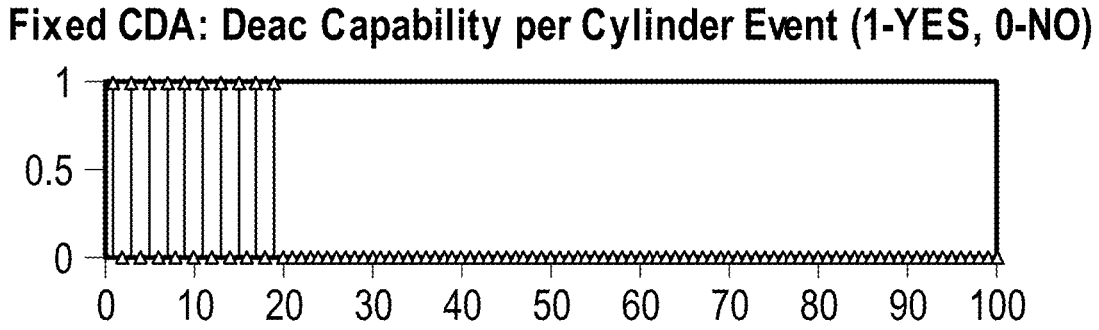
Figure 4C:
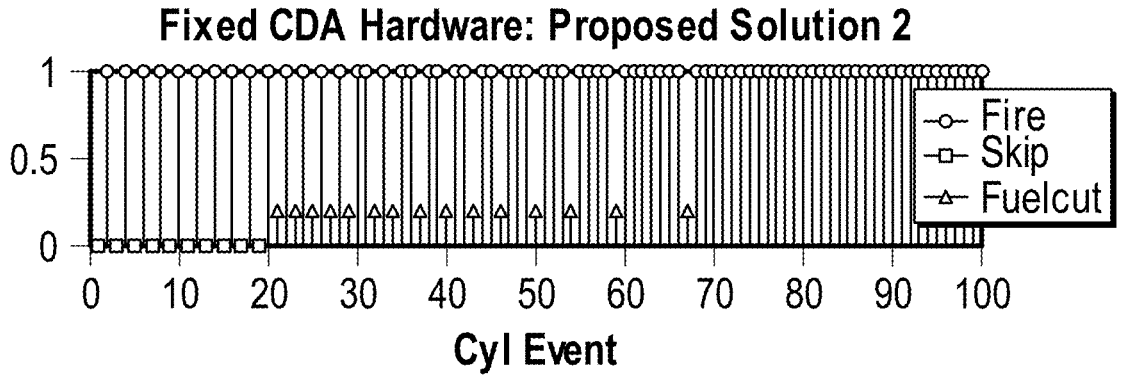

The present invention also can be utilized in a fixed-CDA engine in which the cylinders are not individually deactivatable. That is, the physical hardware is limited to switching all of the deactivatable cylinders at the same time such that either all of the deactivatable cylinders are deactivated, or none of the deactivatable cylinders are deactivated. Hence, ramping of the induction ratio is not possible and the change in induction ratio is abrupt once the target firing fraction is set to 1.0. Nevertheless, it is still beneficial to perform skip-fire engine control. When the transition from a firing fraction of 0.5 to a firing fraction of 1.0 begins, all skip commands are actuated as fuel cut commands. This is shown in FIGS. 4A-4C. FIG. 4A shows an example transition from a firing fraction of 0.5 (e.g., firing three cylinders in a six-cylinder engine) to a firing fraction of 1.0 (e.g., firing all six cylinders in a six-cylinder engine). The firing fraction is shown in the vertical axis and the cylinder event is shown in the horizontal axis. As shown in FIG. 4B, when the firing fraction remains at 0.5, all of the deactivatable cylinders are deactivated. As soon as the transition to a firing fraction of 1.0 begins at cylinder event 20, none of the deactivatable cylinders are deactivated. So, starting at cylinder event 20, cylinders that are commanded to skip instead have their fuel cut, as shown in FIG. 4C. Using the method shown in FIGS. 4A-4C, the NVH can be maintained in a manner similar to that attained true dynamic skip fire. The air path does not need to change abruptly since the per cylinder load on the firing cylinders is ramped slowly while moving to the target firing fraction. Therefore, EGR/Boost pressure do not have to change instantaneously when the induction ratio changes since the set points are based on a per cylinder basis.

Using methods shown in FIGS. 3A-3D and 4A-4C, cutting fuel to non-deactivatable cylinders makes it possible to slowly increase or decrease the firing fraction and keep the firing pulses evenly spaced while maintaining torque delivery and NVH even with engines that do not have CDA capability on all cylinders. By not fueling all of the cylinders, there is no over-delivery of torque. Also, by slowly transitioning the firing fraction, the air path has more time to respond. Also, the in-cylinder load changes much more gradually, rather than jumping abruptly and there is improved air flow and emissions.

It should be understood that the present application contemplates a wide variety of operational state implementations. In some approaches, for example, an operational state involves a predetermined number of deactivatable working chambers and a predetermined number of non-deactivatable working chambers. (The aforementioned numbers may be zero or higher). Thus, different operational states have different numbers of non-deactivatable and deactivatable working chambers. In other embodiments, an operational state involves a particular firing fraction. Thus, different operational states involve firing selected working chambers to deliver different firing fractions. In some implementations, the working chambers that are non-deactivatable and deactivatable are fixed while the corresponding operational state is in effect. In other implementations, this is not required and any or all of the working chambers may fire during one engine cycle and be skipped during the next. Some approaches contemplate two different operational states that have the same number of predetermined, non-deactivatable working chambers, but are different in that each operational state requires operating the deactivatable working chambers to deliver different firing fractions. Additionally, the present application discusses various way of transitioning between two different operational states. It should be appreciated that during the transition, the working chambers of the engine may be operated in accordance with one of those two operational states, or in accordance with a third, distinct operational state. Also, the transition between engine displacements could include any number and type of engine displacements, such as ¼, ½, ¾, 1, etc. Therefore, the present embodiments should be considered illustrative and not restrictive and the invention is not to be limited to the details given herein.

It should be understood that the invention is not limited by the specific embodiments described herein, which are offered by way of example and not by way of limitation. Variations and modifications of the above-described embodiments and its various aspects will be apparent to one skilled in the art and fall within the scope of the invention, as set forth in the following claims.

What is claimed is:

1. A method of managing transitions between operational states of an internal combustion engine having a plurality of working chambers, a first working chamber of the plurality of working chambers being non-deactivatable during operation of the internal combustion engine, the method comprising:

operating the engine in a skip fire manner during a transition between a first displacement and a second displacement of the engine comprising:

generating a firing sequence that includes one or more firing and skip commands for operating the working chambers;

determining whether the skip command involves the first working chamber; and when the skip command involves the first working chamber, cutting the fuel to the first working chamber.

2. The method of claim 1, wherein operating the engine in the skip fire manner during a transition includes transitioning the engine between the first displacement and the second displacement with all skip commands actuated as fuel cut commands.

3. The method of claim 1, wherein if none of the working chambers are individually deactivatable, all skip commands are actuated as fuel cut commands.

4. The method of claim 1, further comprising adjusting operational parameters of the internal combustion engine to control output of the internal combustion engine to be substantially equal to a desired engine output.

5. The method of claim 4, wherein adjusting comprises controlling s a fuel injector of each working chamber in order to cut fuel to non-deactivatable working chambers.

6. The method of claim 1, wherein the internal combustion engine is a lean-burning engine.

7. The method of claim 6, wherein the internal combustion engine is a fixed-CDA engine in which the working chambers are not individually deactivatable.

8. An engine controller to manage transitions between operational states of an internal combustion engine having a plurality of working chambers, a first working chamber of the plurality of working chambers being non-deactivatable during operation of the internal combustion engine, the engine controller configured to perform a following comprising:

operate the engine in a skip fire manner during a transition between a first displacement and a second displacement comprising:

generate a firing sequence that includes one or more firing and skip commands for operating the working chambers;

determine whether the skip command involves the first working chamber; and when the skip command involves the first working chamber, cut the fuel to the first working chamber.

9. The engine controller of claim 8, wherein operating the engine in the skip fire manner during a transition includes the controller configured to transition the engine between the first displacement and the second displacement with all skip commands actuated as fuel cut commands.

10. The engine controller of claim 8, wherein if none of the working chambers are individually deactivatable, all skip commands are actuated as fuel cut commands.

11. The engine controller of claim 8, wherein the engine controller is further configured to adjust operational parameters of the internal combustion engine to control output of the internal combustion engine to be substantially equal to a desired engine output.

12. The engine controller of claim 8, wherein the internal combustion engine is a lean-burning engine.

13. The engine controller of claim 12, wherein the internal combustion engine is a fixed-CDA engine in which the working chambers are not individually deactivatable.

14. A system, comprising:

an engine controller to manage transitions between a first displacement and a second displacement of an internal combustion engine having a plurality of working chambers, a first working chamber of the plurality of working chambers being non-deactivatable during operation of the internal combustion engine, the engine controller configured to perform a following comprising:

operate the engine in a skip fire manner during a transition comprising:

generate a firing sequence that includes one or more firing and skip commands for operating the working chambers;

determine whether the skip command involves the first working chamber; and when the skip command involves the first working chamber, cut the fuel to the first working chamber.

15. The system of claim 14, further comprising a power train parameter adjusting module configured to adjust operational parameters of the engine to control output of the engine to be substantially equal to a desired engine output.

16. The system of claim 15, wherein the power train parameter adjusting module comprises a fuel module that controls a fuel injector of each working chamber in order to cut fuel to non-deactivatable working chambers.

17. The system of claim 14, further comprising a firing timing determination module configured to generate the firing sequence that includes the one or more firing and the skip commands for operating the working chambers.

18. The system of claim 17, wherein the firing timing determination module comprises a sigma delta converter.

19. The system of claim 14, wherein the internal combustion engine is a lean-burning engine.

20. The system of claim 14, wherein the internal combustion engine is a fixed-CDA engine in which the working chambers are not individually deactivatable.

* * * * *